US005598976A

United States Patent [19]

Jang et al.

[11] Patent Number: 5,598,976

[45] Date of Patent: Feb. 4, 1997

[54] SPRAY ARM PULSATION DEVICE OF A DISH WASHER

[75] Inventors: Jae W. Jang; See M. Jeon, both of Seoul, Rep. of Korea

[73] Assignee: Goldstar Co., Ltd., Seoul, Rep. of Korea

[21] Appl. No.: 160,127

[22] Filed: Dec. 2, 1993

[30] Foreign Application Priority Data

Dec. 4, 1992 [KR] Rep. of Korea ..... 1992-23321
Dec. 30, 1992 [KR] Rep. of Korea ..... 1992-26373

[51] Int. Cl.[6] ..... B05B 3/06

[52] U.S. Cl. ..... 239/246; 239/251; 239/255

[58] Field of Search ..... 239/97, 98, 251, 239/256–258, 246, 252, 255, 262

[56] References Cited

U.S. PATENT DOCUMENTS 3,078,045 2/1963 Meuche ..... 239/255
3,447,752 6/1969 Hardy ..... 239/251
3,596,834 8/1971 Cushing ..... 239/251
3,598,316 8/1971 Johnson ..... 239/251
3,771,725 11/1973 Jenkins et al. ..... 239/251
4,884,585 12/1989 Oh ..... 239/255

FOREIGN PATENT DOCUMENTS 235800 10/1959 Australia ..... 239/256

*Primary Examiner*—Karen B. Merritt
*Attorney, Agent, or Firm*—Morgan & Finnegan

[57] ABSTRACT

A spray arm of a dish washer having improved washing efficiency by providing the spray arm to pulsate through utilizing the feeding and draining action of washing water, comprises first and second rotation nozzles oppositely formed in each end of the spray arm; a ball moved by washing water fed into the spray arm and the weight of the ball itself, the ball for closing either one of the first and the second nozzles, and a guide member for guiding the ball to move only in one direction.

5 Claims, 4 Drawing Sheets

SPRAY ARM PULSATION DEVICE OF A DISH WASHER

FIELD OF THE INVENTION

This invention relates to a spray arm pulsation device of a dish washer, more particularly to a spray arm of a dish washer having improved washing efficiency by providing the spray arm to pulsate through utilizing the feeding and draining action of washing water.

BACKGROUND OF THE INVENTION

A spray arm 1*a* of a conventional dishwasher is, as shown in FIGS. 1 and 2, rotatably mounted at the center of a feed water pipe 13 which is installed on the bottom 20 of a dish washer. The spray arm 1*a* has washing nozzles 10 on upper part thereof for spraying washing water toward dishes, and rotation nozzles 11 for generating rotation force by the reaction of washing water sprayed therefrom.

When the feed water is, pressurized by a pump(not shown) and fed through the feed water pipe 13, sprayed from the rotation nozzles 11, the spray arm 1*a* is rotated by the reaction of the feed water spray from the rotation nozzles 11 only in one direction while washing the dishes by the spraying water from the washing nozzles 10.

In another conventional spray arm 16 as shown in FIGS. 3 and 4, when the feed water, pressurized by a pump(not shown), is fed inside of the spray arm 1*b*, ball 6*a* in the spray arm 1*b*, moved by water pressure, close rotation nozzles 4*a* and 5*a* alternatively changing the direction of spray resulting in a to change of the direction of rotation of the spray arm.

However, the conventional spray arm 1*a* as shown in FIGS. 1 and 2 described above has low washing efficiency due to the existence of a dead zone of spray developed by the one direction rotation of the spray arm 1*a* forced by water sprayed from the rotation nozzle 11 provided for producing a rotation force.

On the other hand, the conventional spray arm 1*b* in FIGS. 3 and 4, which has ball 6*a* in the spray arm 1*b*, resting in the neutral position before starting, repeating the action of closing either one of the rotation nozzles on feeding of water and returning to the neutral position on stop of the feed of water, also has low washing efficiency because the spray arm 1*b* can hardly be expected to rotate reversing periodically, as the probability of closing either one of the rotation nozzles 4*a* and 5*a* by the ball 6*a* is half and half resulting in the closing of the rotation nozzles being irregular, contrary to the required sequential closing of the rotation nozzles 4*a* and 5*a* by the ball 6*a* for the periodic reversing of the spray arm 1*b*.

SUMMARY OF THE INVENTION

The object of this invention is providing a spray arm of a dish washer having improved washing efficiency by widening the range of the spray of the washing water by causing the spray arm to pulsate, without supply of separate power, through utilizing the pressure of the washing water fed to the spray arm.

This and other objects and the features of this invention can be achieved by providing a spray arm pulsation device of a dish washer including first and second nozzles formed in opposite direction at the end of the spray arm for spraying washing water, a ball for closing either one of the first and the second rotation nozzles moved by washing water, and a guide member-for guiding the ball to move only in one direction so that the nozzle spraying washing water can be changed from the first; to the second nozzle to change the direction of rotation of the spray arm.

DETAILED DESCRIPTION OF THE INVENTION

Figure 1:
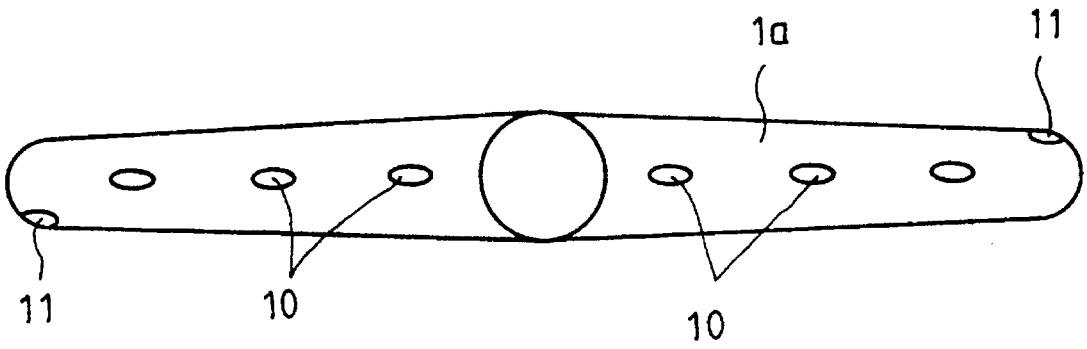
FIG. 1 PRIOR ART
FIG. 1 is a plan view of a conventional spray arm of a dish washer
Figure 2:
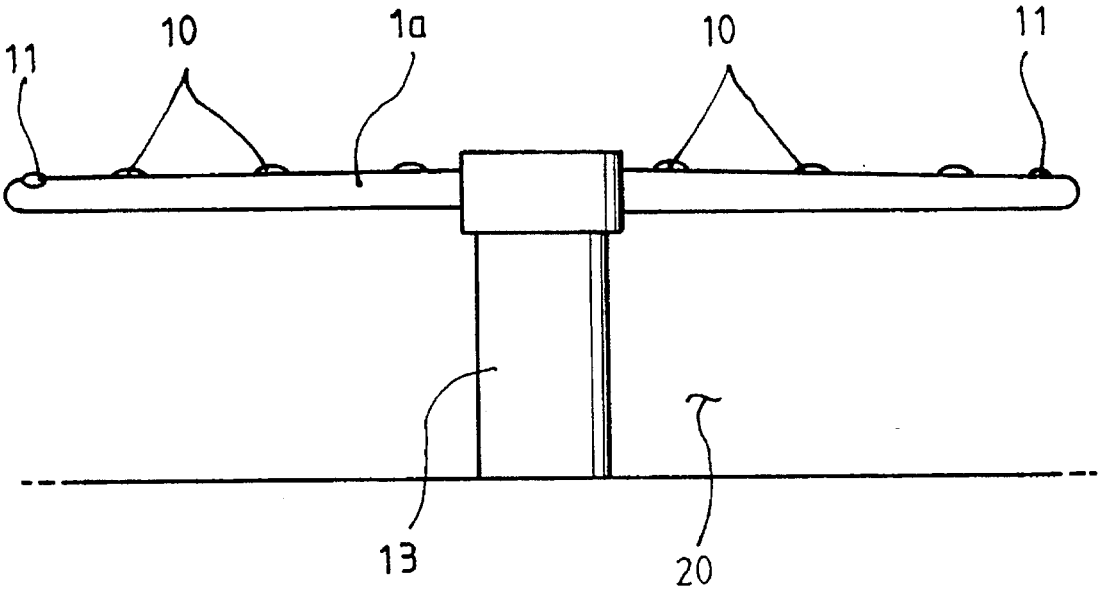
FIG. 2 PRIOR ART
FIG. 2 is a front view of a conventional spray arm of a dish washer.
Figure 3:
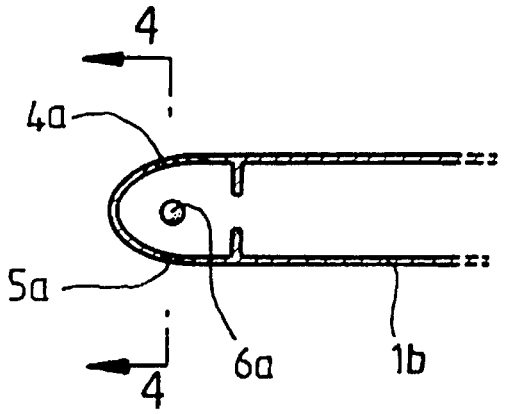
FIG. 3 PRIOR ART
FIG. 3 is a sectional view of a part of another conventional spray arm of a dish washer.
Figure 4:
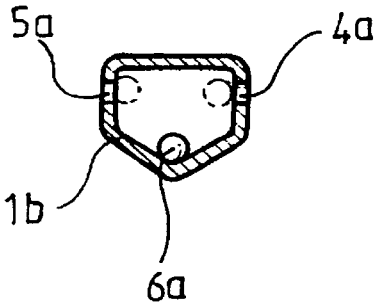
FIG. 4 PRIOR ART
FIG. 4 shows 4—4 section of FIG. 3.
Figure 5:
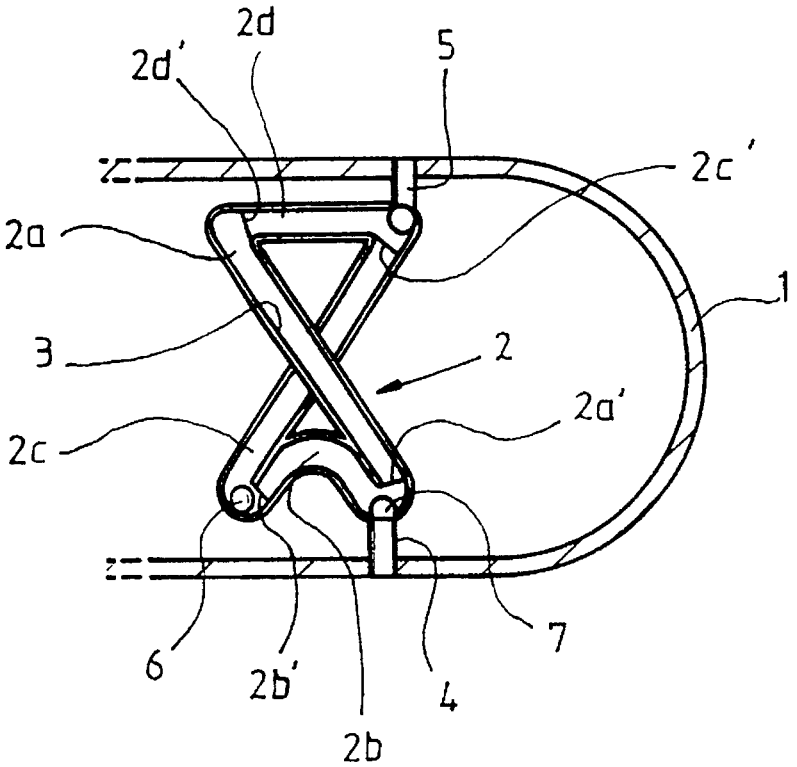
FIG. 5 is a sectional view of a part of a spray arm of a dish washer in accordance with this invention.
Figure 6:
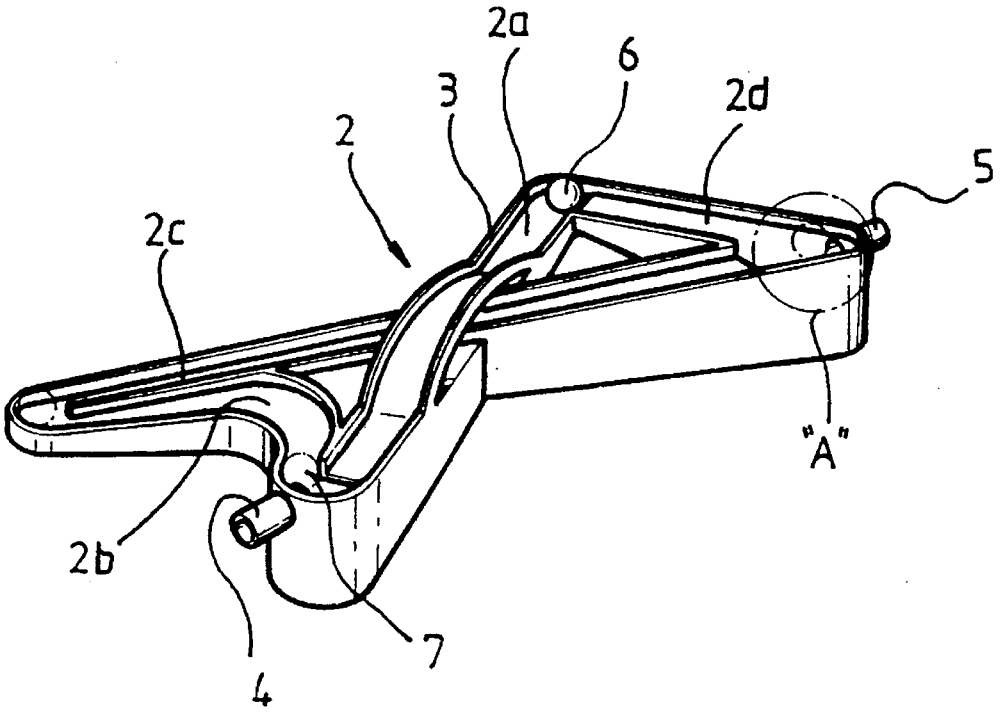
FIG. 6 is a perspective view of a guide member of a spray arm of a dish washer in accordance with this invention.
Figure 7:
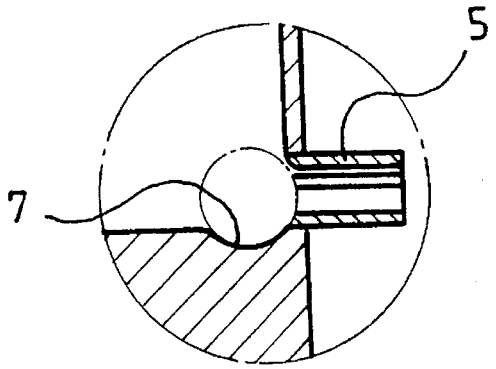
FIG. 7 is an enlarged sectional view of part "A" of FIG. 6.

FIGS. 5 to 7 show a spray arm of a dish washer in accordance with one embodiment of this invention including a guide member 2 formed to have a two level crossing with a step at each end of guide rails 2*a*, 2*b*, 2*c* and 2*d*, and the guide rails 2*a*, 2*b*, 2*c* and 2*d* each formed to have a slope ended with a step between them, provided with guard rails 3 at both sides thereof to prevent falling down.

In the guide member 2, first and second rotation nozzles 4 and 5 used also as washing water outlets positioned oppositely are provided at the guide rails 3 between the first and the second guide rails 2*a* and 2*b*, and the third and the fourth guide rails 2*c* and 2*d* connected with the spray arm 1, and a ball 6 made of glass or plastic is on the guide rail 2*a*, 2*b*, 2*c* and 2*d* for closing the first and the second rotation nozzles 4 and 5 alternatively through moving in one direction along the first, the second, the third and the fourth guide rails 2*a*, 2*b*, 2*c* and 2*d* forced by washing water and the weight of the ball itself. A recess 7 for the rest of the ball is provided at each entrance of the rotation nozzles 4 and 5.

The first guide rail 2*a* is sloped so that a first end is lower than a second end, the second guide rail 2*b* is sloped so that a first end connected with the second end of the first guide rail is higher than a second end. The first end of the second guide rail is connected with the first nozzle. The third rail 2*c* is sloped so that a first end connected with the second end of the second guide rail is lower than a second end, and the fourth guide rail 2*d* is sloped so that a first end connected with the second end of the third guide rail is higher than a second end. The first end of the fourth guide rail is connected with the second nozzle and the second end is connected with the first end of the first guide rail.

Accordingly, the ball 6 is forced to move by the washing water fed to the spray arm 1 from the first guide rail to the second guide rail and from the third guide rail to the fourth guide rail, and the ball 6 moves by its weight from the second guide rail 2*b* to the third guide rail and from the fourth guide rail to the first guide rail.

Figure 8:
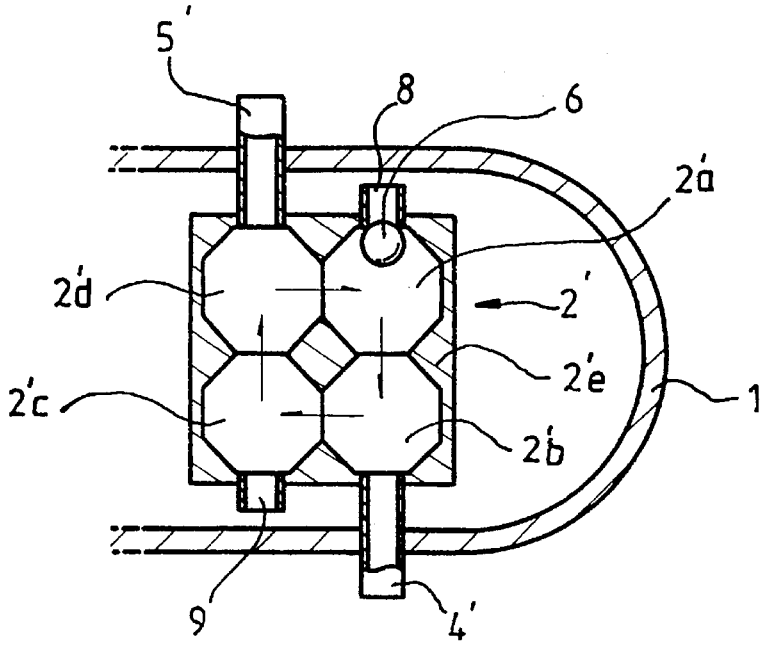
FIG. 8 is sectional view of a part of a spray arm of a dish washer in accordance with another embodiment of this invention.
Figure 9:
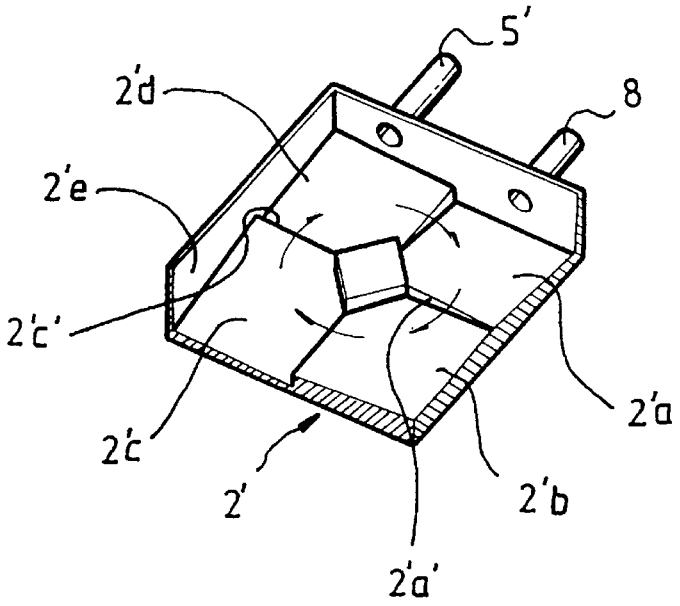
FIG. 9 is a cut away perspective view in part of a guide member of a spray arm of a dish washer in accordance with another embodiment of this invention.

FIGS. 8 and 9 show another embodiment of this invention including, at the end of the spray arm 1, a guide member 2' having first, second, third and fourth sloped guide surfaces 2'*a*, 2'*b*, 2'*c* and 2'*d* each separated by independent separation room 2'*e* with steps at the boundaries of the surfaces and, on the top and the bottom of each side of the guide member 2, oppositely positioned first and second rotation nozzles 4' and 5' used also as washing water outlets are provided on the second and the fourth guide surfaces 2'*b* and 2'*d*.

On one side of the first and the second rotation nozzles 4' and 5' used also as washing water outlets in the guide member 2', washing water inlets 8 and 9 are provided in the first and the third sloped guide surfaces 2'*a* and 2'*c* for the flow in of the fed washing water, and, on the first, the second, the third and the fourth sloped guide surfaces 2'*a*, 2'*b*, 2'*c* and 2'*d* of the guide member 2', a ball 6 for alternative closing of the first and the second rotation nozzles 4' and 5' through moving in one direction along the first, the second, the third and the fourth sloped guide surfaces 2'*a*, 2'*b*, 2'*c* and 2'*d* forced by washing water flowing in through the washing water inlets 8 and 9, and by the weight of the ball itself.

The first sloped guide surface 2'*a* is sloped so that one side is lower than an opposite side. A washing water inlet 8 is in the wall of the one side. The third sloped guide surface 2'*c* is sloped so that one side is lower than an opposite side. A washing water inlet 9 is in the wall of the one side. The second sloped guide surface 2'*b* is connected with the first rotation nozzle, and has one side which is in contact with the opposite side of the first sloped guide surface, and is formed to have a slope higher than the third sloped guide surface. The fourth sloped guide surface 2'*d* is connected with the second rotation nozzle, and has one side which is in contact with the opposite side of the third sloped guide surface, and is formed to have a slope higher than the first sloped guide surface.

The spray arm in accordance with one embodiment of this invention, as shown in FIGS. 5 to 7, rotates in a clockwise direction because the ball 6 moves along the first sloped guide rail 2*a* forced by the washing water to close the first rotation nozzle 4 which is used also as a washing water outlet, this results in the washing water being sprayed through the second rotation nozzle 5. The water which is pressurized by a pump (not shown) flows into the spray arm 1 through a feed water pipe. Because the ball 6 has a higher specific weight than water, the ball 6 rests at one end of the first guide rail 2*a* in the guide member 2 mounted in the spray arm 1 of a dish washer.

Thereafter, when the feed of washing water to the spray arm 1 is stopped, the ball 6, which is closing the first rotation nozzle 4, is unable to move toward the first guide rail 2*a* due to the step 2*a'* and this moves down to the third guide rail 2*c* through the second sloped guide rail 2*b* by the weight of the ball itself.

At this time, when washing water is again fed to the spray arm 1, the ball 6 resting at one end of the third guide rail 2*c*, is unable to move over toward the second guide rail due to the step 2*b'* of the second guide rail, and thus moves along the third guide rail 2*c* forced by the water feed and closes the second rotation nozzle 5 so that the washing water is sprayed through the first nozzle 4 to force to rotate the spray arm 1 in anti-clock wise direction.

Then, when the water feed to the spray arm 1 is stopped, the ball 6, as shown in FIG. 7, is unable to move toward the third guide rail 2*c* due to the step 2*c'* at the third guide rail 2*c*, and thus moves down along the fourth sloped guide rail 2*d* to return to one end of the first guide rail 2*a* by the weight of the ball itself, which ball 6, then, when the water feed to the spray arm 1 is started again, is unable to move toward the fourth rail 2*d* due to the step 2*d'* at the fourth guide rail 2*d*, and thus moves up to the first guide rail forced by the water feed.

Thus, the ball 6 repeats the aforementioned processes, causing the spray arm 1 to pulsate.

In the meantime, as guard rail 3 is formed on both sides of the first, the second, the third and the fourth guide rails 2*a*, 2*b*, 2*c* and 2*d* of the guide member 2, the ball 6 is prevented from falling down, and as recesses are formed on the bottom of the first and the second, and the third and the fourth guide rail 2*a*, 2*b*, 2*c* and 2*d* at the entrances to the first and the second rotation nozzles 4 and 5, the ball 6 can stay stable without any movement during the closure of the first and the second rotation nozzles 4 and 5.

On the other hand, when the washing water fed to the spray arm enters into the separated room 2'*e* through the washing water inlets 8 and 9, as shown in FIGS, 8 and 9, while the Washing water inlet 8 in the first sloped guide surface 2'*a* in guide member 2' in the spray arm 1 of the dish washer, is kept closed by the ball 6, the ball 6 is pushed toward the second sloped guide surface 2'*b* over the step of the first sloped guide surface 2'*a* resulting in the closure of the first rotation nozzle 4' used also as a washing water outlet so that the spray arm rotates in clockwise direction by the washing water sprayed from the second rotation nozzle 5' in the fourth sloped guide surface 2'*d* of the guide member 2'. When the water feed to the spray arm 1 is stopped, the ball 6 is unable to move toward the first sloped guide surface 2'*a* due to the step 2'*a'* of the first sloped guide surface 2'*a*, and thus moves down to the third sloped guide surface 2'*c* from the second sloped guide surface 2'*b* due to the slope of the second sloped guide surface 2'*b* by the weight of the ball itself.

When the water is again fed to the spray arm 1 and into the separation room 2'*e* through the washing water inlets 8 and 9 in the first and the third sloped guide surfaces 2'*a* and 2'*c* of the guide member 2' the spray arm 1 rotates in a counter clockwise direction because the ball 6, which was closing the washing water inlet 9 of the third sloped guide surface 2'*c*, closes the second rotation nozzle 5' used also as a washing water outlet in the fourth sloped guide surface 2'*d* because the ball is pushed over the step 2'*c'* of the third sloped guide surface 2'*c* toward the fourth sloped guide surface 2'*d* by the force of the water feed resulting in the water feed being sprayed from the first rotation nozzle 4'.

When the water feed to the spray arm 1 is stopped, the ball 6, as shown in FIG. 9, is unable to move to the sloped third guide surface 2'*c* due to the step 2'*c'* of the third sloped guide surface 2'*c*, but moves down to the first sloped guide surface 2'*a* along the fourth sloped guide surface 2'*d* by the weight of the ball itself. Thus, the spray arm 1 pulsates in accordance with the aforementioned operation sequence.

As seen from aforementioned description, this invention can improve the washing efficiency of a dish washer by providing a guide member in a spray arm including a ball having higher specific gravity than the washing water closing the first and the second rotation nozzles alternatively, without supply of separate power, moving in one direction forced by the water feed to the spray arm and the weight of the ball itself causing the spray arm to pulsate to widen the range of the spray of the spray arm.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

What is claimed is:

1. A spray arm pulsation device of a dish washer comprising, first and second rotation nozzles oppositely formed in each end of the spray arm;

a ball moved by washing water fed into the spray arm and the weight of said ball itself, said ball allowing for closing either one of said first and said second nozzles; and a guide member for guiding said ball to move only in one direction.

2. A spray arm pulsation device according to claim 1, wherein said guide member includes a fourth guide rail having a first and a second end and connected with said first rotation nozzle, a second guide rail having a first and a second end and connected with said second rotation nozzle, a third guide rail having a first and a second end and connecting the second guide rail with the fourth guide rail, and a first guide rail having a first and a second end and connecting the fourth guide rail with the second guide rail, and the first, the second, the third and the fourth guide rails being constructed such that the movement of the ball from the first guide rail to the second guide rail and from the third guide rail to the fourth guide rail is carried out by the force of washing water, while the movement of the ball from the second guide rail to the third guide rail and from the fourth guide rail to the first guide rail is carried out by the weight of the ball itself.

3. A spray arm pulsation device according to claim 2, wherein:

the first guide rail is sloped such that said first end is lower than said second end;

the second guide rail is sloped such that said first end thereof which is connected with said second end of the first guide rail is higher than said second end of the second guide rail, said first end of said second guide rail being in communication with said first rotation nozzle;

the third guide rail is sloped such that the first end thereof which is connected with said second end of the second guide rail is lower than the second end of the third guide rail; and the fourth guide rail is sloped such that said first end which is connected with said second end of the third guide rail is higher than said second end of said fourth rail which is connected with said first end of the first guide rail, and said first end of said fourth rail being in communication with the second rotation nozzle.

4. A spray arm pulsation device according to claim 1, wherein said guide member includes a fourth sloped guide surface connected with said second rotation nozzle, a second sloped guide surface connected with said first rotation nozzle, a third sloped guide surface connecting the second sloped guide surface with the fourth sloped guide surface, and a first sloped guide surface connecting the fourth sloped guide surface with the second sloped guide surface, and the first, the second, the third and the fourth, sloped guide surfaces being constructed such that the movement of said ball from the first sloped guide surface to the second slope guide surface and from the third sloped guide surface to the fourth sloped guide surface is carried out by the force of the washing water, while the movement of said ball from the second sloped guide surface to the third sloped guide surface and from the fourth sloped guide surface to the first sloped guide surface is carried out by the weight of said ball itself.

5. A spray arm pulsation device according to claim 4, wherein:

the first sloped guide surface is sloped such that one side is lower than an opposite side and a washing water inlet is within a wall of the one side;

the third sloped guide surface is sloped such that one side is lower than an opposite side and a washing water inlet is within a wall of the one side;

the second sloped guide surface is connected with the first rotation nozzle, has one side which is in contact with said opposite side of the first sloped guide surface, and is sloped higher than the third sloped guide surface; and the fourth sloped guide surface is connected with the second rotation nozzle, has one side which is in contact with said opposite side of the third sloped guide surface, and is sloped higher than the first sloped guide surface.

* * * * *